US007575275B2

(12) United States Patent
Jones

(10) Patent No.: US 7,575,275 B2
(45) Date of Patent: Aug. 18, 2009

(54) BLEACHER CUSHION

(75) Inventor: Troy Jones, Maize, KS (US)

(73) Assignee: Integrated Stadium Seating, Inc., Wichita, KS (US)

( * ) Notice: Subject to any disclaimer, the term of this patent is extended or adjusted under 35 U.S.C. 154(b) by 626 days.

(21) Appl. No.: 11/172,171

(22) Filed: Jun. 30, 2005

(65) Prior Publication Data

US 2006/0022499 A1 Feb. 2, 2006

Related U.S. Application Data

(63) Continuation-in-part of application No. 10/846,136, filed on May 14, 2004, now Pat. No. 6,926,360, which is a continuation of application No. 10/348,785, filed on Jan. 22, 2003, now Pat. No. 6,739,667, application No. 11/172,171, which is a continuation-in-part of application No. 10/890,818, filed on Jul. 14, 2004, now Pat. No. 7,104,605, which is a continuation-in-part of application No. 10/846,136, application No. 11/172, 171, which is a continuation-in-part of application No. 11/046,366, filed on Jan. 28, 2005, now abandoned, which is a continuation of application No. 10/846,136.

(51) Int. Cl.
*A47C 1/08* (2006.01)

(52) U.S. Cl. ..... 297/252; 297/352; 297/230.11; 297/254; 297/256

(58) Field of Classification Search ..... 297/19, 297/230.1, 230.11, 230.12, 230.14, 252, 297/352
See application file for complete search history.

(56) References Cited

U.S. PATENT DOCUMENTS 2,046,198 A * 6/1936 Letts ..... 297/252
2,059,493 A * 11/1936 Schoenhoff ..... 297/252
2,152,014 A * 3/1939 Ashe et al. ..... 297/252
2,260,352 A 10/1941 Trapani
2,545,840 A * 3/1951 Browne ..... 297/252
2,702,076 A * 2/1955 Beardsley et al. ..... 297/252
2,707,513 A 5/1955 Lake
2,754,891 A 7/1956 Barron
2,756,808 A 7/1956 Eichorst
2,792,875 A * 5/1957 Pirrone ..... 297/252
3,066,980 A * 12/1962 Clute ..... 297/252
3,556,589 A 1/1971 Messier
4,394,783 A 7/1983 Simmons
4,824,169 A 4/1989 Jarrell
5,190,350 A * 3/1993 Hwang et al. ..... 297/380
5,384,923 A * 1/1995 Hwang et al. ..... 5/419
5,516,193 A * 5/1996 Simpson ..... 297/252

(Continued)

OTHER PUBLICATIONS

College Comfort Stadium Chair Back Program brochure; College Comfort LLC; 8 pages.

*Primary Examiner*—Laurie K Cranmer
(74) *Attorney, Agent, or Firm*—Dorsey & Whitney LLP; Jason M. Hunt; Brian J. Laurenzo

(57) ABSTRACT

A seat cushion includes a cushioned bottom portion and a back portion. The back portion is flexibly connected to the bottom portion. An attachment mechanism is provided to attach the bottom portion to a bleacher. A constraint element restrains the back portion for rotating beyond a desired angle with respect to the cushioned bottom portion. The back portion does not include any rigid cross members.

8 Claims, 15 Drawing Sheets

U.S. PATENT DOCUMENTS

| | | | | |
|---|---|---|---|---|
| 5,857,226 | A | 1/1999 | Sommer | |
| 5,868,463 | A | 2/1999 | MacKenzie et al. | |
| 5,934,751 | A * | 8/1999 | Johnson et al. | 297/252 |
| 6,007,572 | A * | 12/1999 | Baldwin | 607/114 |
| 6,352,306 | B1 | 3/2002 | Drieling | |
| 6,502,902 | B1 | 1/2003 | Romero | |
| 6,739,667 | B1 | 5/2004 | Jones | |
| 6,848,746 | B2 * | 2/2005 | Gentry | 297/380 |
| 6,926,360 | B2 | 8/2005 | Jones | |
| 6,935,686 | B1 * | 8/2005 | Liao | 297/252 |
| 7,104,605 | B2 | 9/2006 | Jones | |
| 7,316,452 | B2 * | 1/2008 | Vestweber | 297/252 |

* cited by examiner 310
324
316
326
328
314
318
334
340
362
330
320
332
312
326
336
362

310
316
324
326
326
328
328
23
23
340
24
318
334
362
344
312
330
338
346
342
336
24

BLEACHER CUSHION

CROSS-REFERENCE TO RELATED APPLICATIONS

This application is a continuation-in-part of U.S. patent application Ser. No. 10/846,136, filed May 14, 2004, which is a continuation of U.S. patent application Ser. No. 10/348,785, filed on Jan. 22, 2003, now U.S. Pat. No. 6,739,667; and a continuation-in-part of U.S. patent application Ser. No. 10/890,818, filed Jul. 14, 2004, which is a continuation-in-part of the '136 application; and a continuation-in-part of U.S. patent application Ser. No. 11/046,366, filed Jan. 28, 2005, which is a continuation of the '136 application; the contents all of which are hereby incorporated by reference.

FIELD OF THE INVENTION

The present invention relates to seat cushions. More specifically, the present invention relates to cushions that are attachable to or usable with stadium seating, such as bleachers.

BACKGROUND OF THE INVENTION

Bleacher-type seating is often provided for spectator events such as sporting events, concerts, and the like. Such seating is often provided in a permanent setting, such as a stadium, a semi-permanent setting, such as retractable bleachers in a gymnasium, or on a temporary basis for specific events. Bleachers provide simple, efficient and convenient seating for a large number of spectators; however, bleachers do not necessarily provide the most comfortable seating nor do they typically identify an individual seating location.

To improve the comfort of such seating, patrons sometimes bring their own seats or cushions. While an improvement in comfort, such a solution requires the patron to remember to bring their own device, which is often an afterthought and/or a very easily overlooked consideration when attending an otherwise exciting event. In addition, having spectators hauling their own chairs or cushion into a stadium seating arrangement can be inconvenient and possibly even dangerous to other spectators. That is, walkways are narrow and space is extremely limited so carrying extra items (especially if large, bulky or cumbersome) presents a challenge.

Thus, there exists a need to balance the conveniences and mass seating offered through stadium or bleacher seating with a degree of personal comfort.

BRIEF SUMMARY OF THE INVENTION

The present invention, according to one embodiment, is a removable seat cushion for attachment to a base portion that includes an upwardly facing support surface. The seat portion includes a bottom cushioned portion adapted to set on the upwardly facing surface to provide a padded seat bottom. An attachment mechanism is provided for attaching the bottom cushioned portion to the base portion. A backrest portion is flexibly connected to the bottom cushioned portion such that the backrest portion will rotate in a generally vertical plane when the bottom cushioned portion is attached to the base portion. A flexible constraint element is attached at a first end to the bottom cushioned portion and at a second end to the backrest portion for restraining the backrest portion from rotating beyond a desired angle with respect to the bottom cushioned portion. Optionally, the flexible constraint element may be an adjustable strap, or a pair of adjustable straps. The attachment mechanism may include a loop on a bottom surface of the bottom cushioned portion which engages a bracket that is adapted to fasten to the base portion. The bracket may include a pair of jaws to engage the bleacher seat. The backrest may be free from any rigid cross members.

According to another embodiment, the present invention is an attachment bracket for attaching a seat cushion to a bleacher seat. The bracket includes a front jaw with a front hook portion for engaging a front portion of a bleacher seat, a long horizontal leg extending from the hook portion to a location near a rear portion of the bleacher seat when the front jaw is in engagement with the front portion of the bleacher seat, and a generally upwardly extending rear leg. A rear jaw is provided for engaging a rear portion of the bleacher seat. The rear jaw includes a generally upwardly extending leg in close proximity to the generally upwardly extending rear leg of the front jaw. A tightening member draws the generally upwardly extending legs together to secure the jaws to the bleacher seat.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. The use of descriptive terms such as up, down, vertical and horizontal are for illustrative purposes only, are not meant to be limiting, and are used by way of example with respect to the illustrations presented.

DETAILED DESCRIPTION

The cushions of the present invention, according to one embodiment, can be used is to provide designated, comfortable seating to select patrons in a stadium seating arrangement. For example, the stadium may rent the present stadium cushions to any patron who so chooses. In such a scenario, stadium personnel would most likely secure all of the stadium cushions to the bleachers in the appropriate locations before the arrival of the patrons. This provides many advantages. For example, it can provide a source of advertising, by allowing printed matter to be prominently displayed on the stadium cushions awaiting the arrival of patrons. It also allows a particular space or seating location to be physically identified and/or reserved for a particular patron.

Alternatively, the cushions of the present invention are quickly attachable and detachable from the stadium seating such that a patron could bring the cushion to the stadium, attach it to the patron's seat, and remove the cushion from the stadium when the patron leaves at the end of the event.

Figure 1:
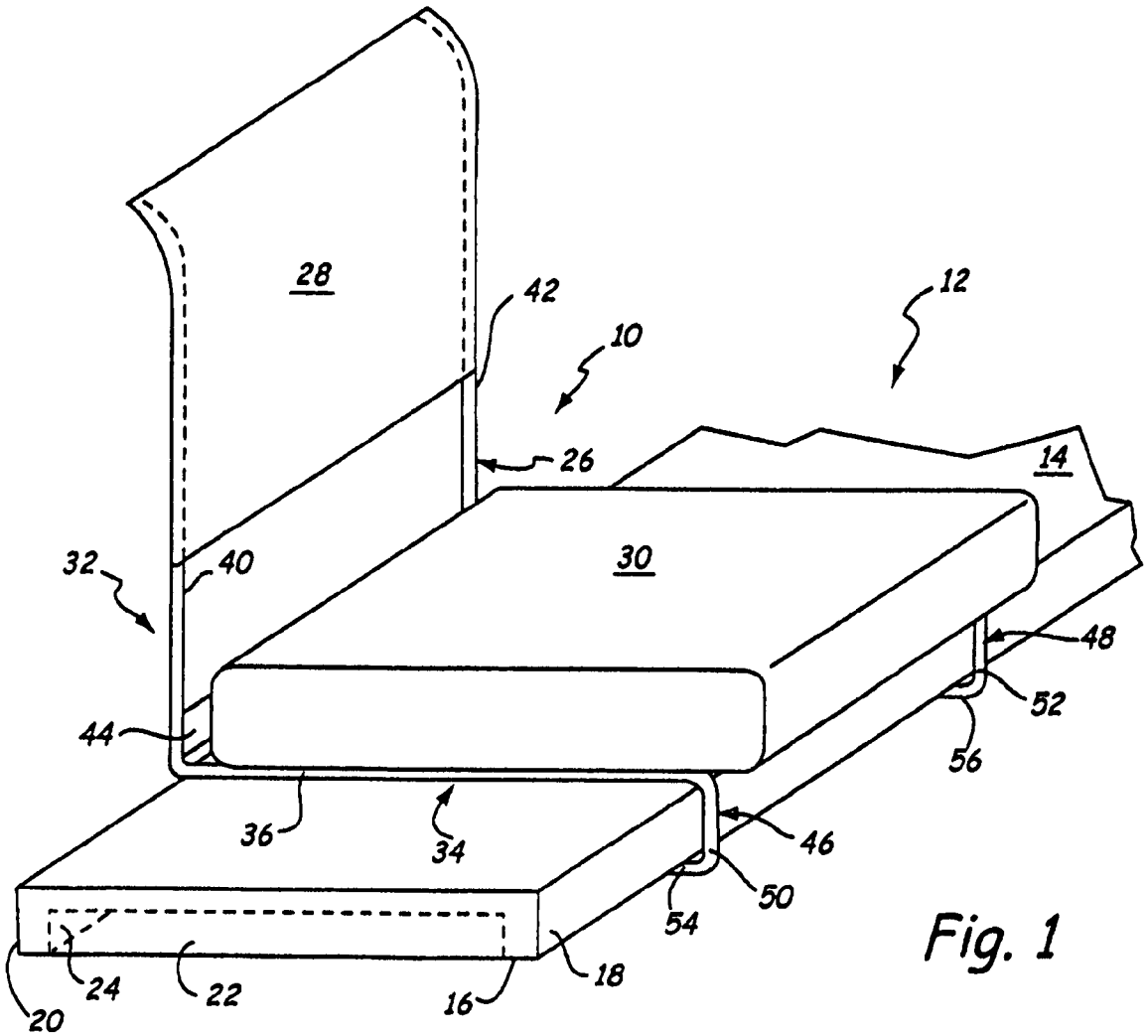
FIG. 1 is an isometric view of a stadium chair attached to a bleacher in accordance with one embodiment of the present invention.

FIG. 1 is an isometric view of a stadium chair 10 attached to a bleacher 12 in accordance with one embodiment of the present invention. The bleacher 12 can take many forms. As illustrated, the bleacher 12 may be an elongated plank-like member having a planar upper seating surface 14, a lower surface 16, a front face 18 and rear face 20. The bleacher 12 may be made from various materials including wood or aluminum. As illustrated in phantom, the bleacher 12 may also include a recess 22 having one or more lips 24 and one or more ribs (not shown) to provide additional structural support.

The stadium chair 10 rests on the upper seating surface 14 and is secured to both the front face 18 and rear face 20 of the bleacher. The particular configuration of the bleacher 12 may affect which particular securement members (described more fully below) should be used.

Figure 2:
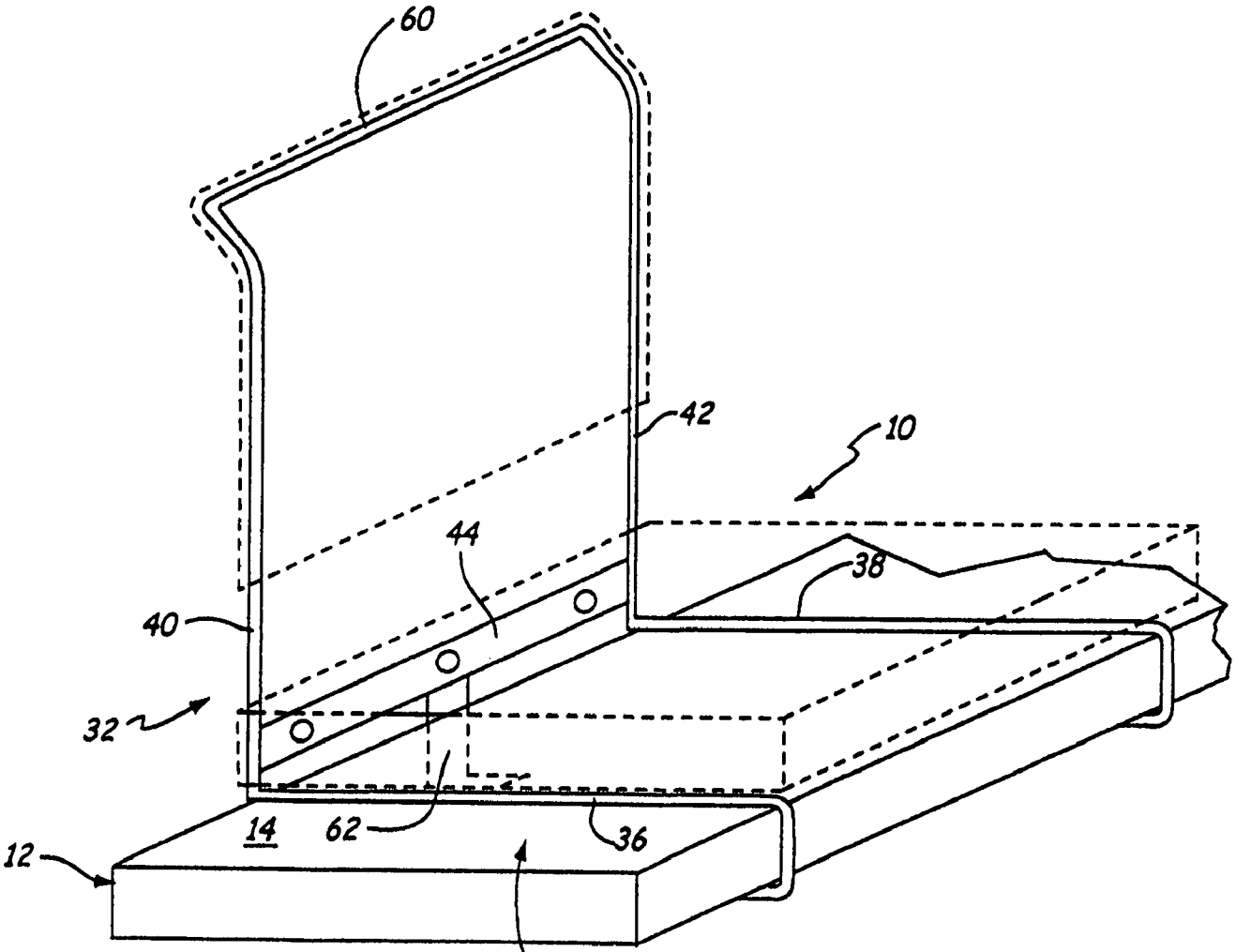
FIG. 2 is a partially sectional view of the stadium chair of FIG. 1.

Referring to FIGS. 1 and 2, the stadium chair 10 includes a frame 26. As illustrated, frame 26 is formed from a tubular or cylindrical member that is appropriately bent at predetermined angles to form the frame structure. The frame 26 could be formed from any suitable material such as metal (e.g:, aluminum, steel tubing or steel rod), plastic or the like. The choice of materials will determine whether the frame 26 is formed via bending or as a pre-shaped component (e.g., molded, cast, injection molded). As illustrated, the frame 26 is a single component forming a first generally U-shaped bracket 46 having a first face engaging member 50 and a first lower surface engaging member 54. Likewise, the frame 26 includes at an opposite end a second generally U-shaped bracket 48 having a second face engaging member 52 and a second lower surface engaging member 56.

The frame 26 includes a first horizontal member 36 and a second horizontal member 38 which rest atop the upper seating surface 14 when the stadium chair 10 is positioned as illustrated. The horizontal members 36, 38 define a seat portion 34 of the frame 26. Depending from the horizontal members 36, 38 and extending upwards (as illustrated) is a back portion 32 of the frame 26 that is defined by a first upright member 40 and a second upright member 42. The first and second upright members 40, 42 are optionally interconnected by an upright cross member 60. The upper section of back portion 32 may be angled backwards or away from bleacher 12. This provides a more comfortable seat back for patrons by preventing the upper corners from engaging the back of the patron. In addition, the angled portion aides in securing a backrest 28 to the frame 26. That is, backrest 28 is a flexible member having an interior cavity allowing the backrest 28 to be slipped over the back portion 32. The angle can increase the tension of the backrest 28, making it more secure. In addition, clips (not shown) or other attachment members can be used to temporarily or permanently secure the backrest 28 to the frame 26.

A seat cushion 30 is placed atop the seat portion 34 of frame 26. The seat cushion 30 provides a comfortable seating surface for the patron. The cushion 30 and backrest 28 can be made from any appropriate material such as vinyl, plastic, or the like. If exposed to the environment, the material chosen preferably is suitably durable and/or weather resistant. The cushion 30 and/or the backrest 28 can include a desired amount of padding or cushioning to achieve a desired size, shape and degree of comfort.

In use, the frame 26 is positioned so that the first and second generally U-shaped brackets 46, 48 loop over the front face 18 of the bleacher 12. The shape of the generally U-shaped brackets 46, 48 and the overall rigidity of the frame 26 thus prevent the stadium chair 10 from tipping either forwards or backwards. An attachment bracket 44 is positioned on the back portion 32 of the frame 26, between the first and second uprights 40, 42. The attachment bracket 44 provides additional strength and rigidity to the overall frame assembly. An L-shaped attachment clamp 62 is releasably secured to the attachment bracket 44 and is positioned so that a portion thereof is below the bleacher 12, in contact with lower surface 16, as shown in FIG. 2. Thus, as attachment clamp 62 is tightened against attachment bracket 44, attachment clamp 62 frictionally engages bleacher 12, effectively clamping stadium chair 10 to the bleacher 12. In this manner, stadium chair 10 is prevented from being tilted forwards or backwards; sliding forwards or backwards (e.g., off the bleacher 12), lifted vertically; and if sufficient tension is applied, from sliding horizontally along upper surface 14. Thus, a defined location on the bleacher 12 is presented that provides a comfortable, backed seating position to a patron.

Figure 3:
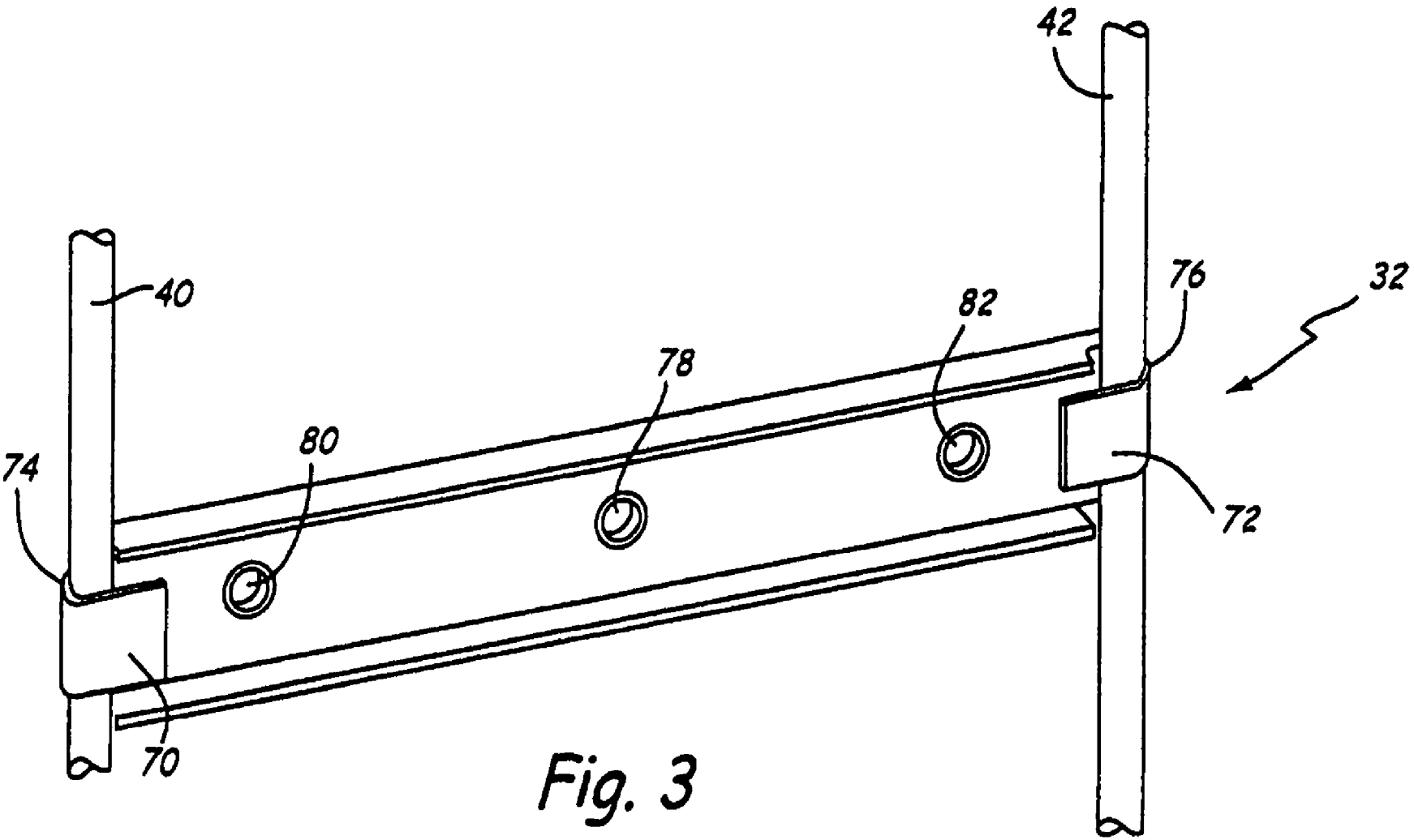
FIG. 3 is an isometric view of a portion of a frame of the stadium chair of FIG. 1 along with an attachment bracket useful in securing the stadium chair to a bleacher.

FIG. 3 is an isometric view of one embodiment of the attachment bracket 44. The attachment bracket 44 is preferably a rigid member made of suitably strong material such as metal. For example, attachment bracket 44 could be stamped, cast, bent or otherwise fabricated from steel, aluminum or the like. Attachment bracket 44 is a channeled member having some degree of depth or thickness. At opposing ends, a first tab 70 and a second tab 72 are provided. The tabs 70, 72 may be bent around upright member 40, 42 respectively to secure the attachment bracket 44 to the frame 26. Other methods of attachment such as bolting, crimping, clamping, welding, or the like may also be used to secure the attachment bracket 44 to the upright members 40, 42 of the frame 26. As the tabs 70, 72 are bent around upright members 40, 42, they form channels 74, 76 that ultimately receive and frictionally engage the upright members 40, 42. Thus, the attachment bracket is securely attached to a given position on the back portion 32 of the frame 26.

The attachment bracket 44 is provided with one or more threaded throughbores 78, 80, 82. If multiple clamps 62 are to be attached they may be balanced by utilizing left and right threaded throughbores 80, 82. If only one clamp 62 is to be used, it may normally be secured to central threaded throughbore 78 or alternatively to any throughbore that is unobstructed. That is, the seat 10 may be positioned as desired and the multiple throughbores 78, 80, 82 provide for multiple attachment points. Thus, if one or more attachment points is obscured or occluded by an obstruction (e.g., a frame member of the bleacher 12), it is a simple matter to utilize one of the other unobstructed attachment points. Fewer threaded throughbores may be provided, more may be provided, and different configurations could also be utilized as desired.

By utilizing an attachment bracket 44, frame 26 can be made as a relatively simple and straightforward component. That is, the frame 26 can be easily and readily produced as can the attachment bracket 44. These two components can be quickly and easily joined to produce a complete frame assembly.

Figure 4:
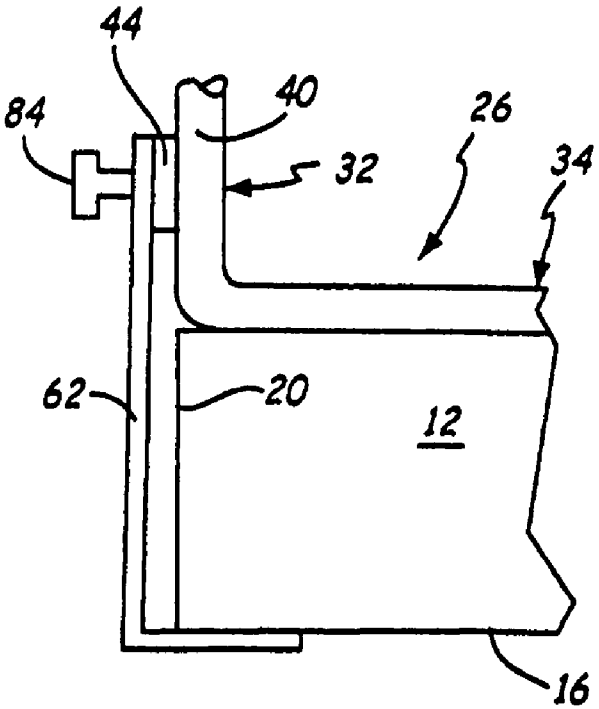
FIG. 4 is a side, planar view illustrating a portion of the stadium chair frame and the attachment to a bleacher with an attachment clamp.

FIG. 4 illustrates how attachment clamp 62 is secured to attachment bracket 44 and how clamp 62 engages bleacher 12. A threaded member such as bolt 84 is passed through an upper portion of clamp 62 so as to engage one of the threaded throughbores 78, 80, 82 illustrated in FIG. 3. Rotating the bolt 84 causes the clamp 62 to abut and engage the attachment bracket 44, in the known way. Thus, by tightening the bolt 84, the clamp 62 is secured; this in turn effectively secures the chair 10 to the bleacher 12. As shown, the clamp 62 is spaced from the rear face 20; however, these two portions could be in contact. Likewise, as illustrated, clamp 62 contacts the lower surface 16; however, a small gap could also be present.

Figure 13:
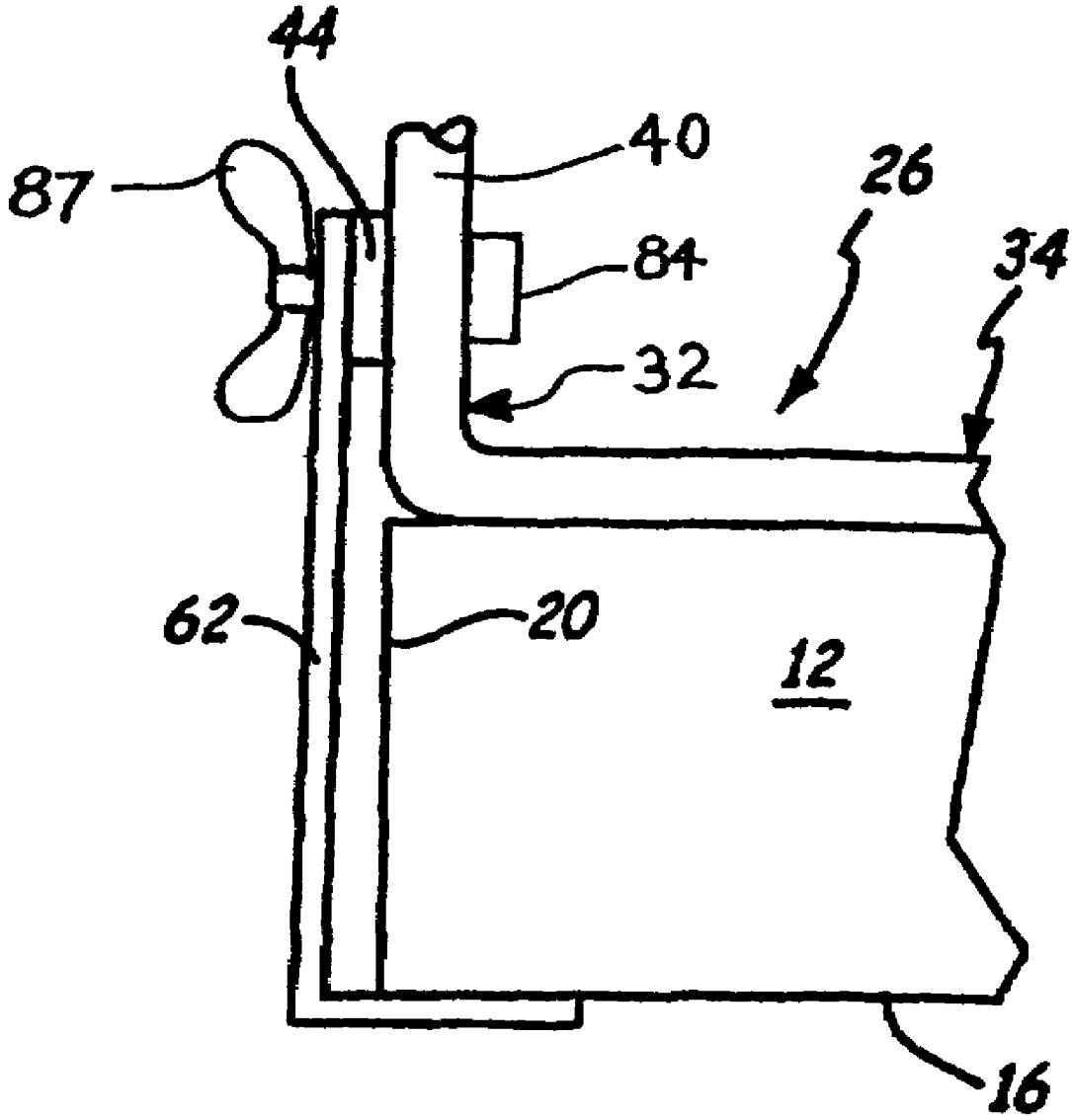
FIG. 13 is a side, planer view illustrating a portion of the stadium chair frame and attachment to a bleacher with an attachment clamp.

In a particularly efficient arrangement, one of the clamps 62 could be loosely attached to each of the chairs 10 prior to installation on the bleachers. Thus, the installer could position the chair 10, pivot the clamp into place, tighten the bolt 84 with a wrench or the like and the chair 10 is installed. When installing hundreds or even thousands of chairs at one time, this efficiency is well placed. Alternatively, various other known attachment mechanisms could be used to secure the clamp 62 to the attachment bracket 44. For example, as shown in FIG. 13, the throughbore 78, 80, 82 need not be threaded. Rather, a threaded member 84 (e.g., a bolt) could be passed therethrough and secured with a fastener 87, such as a nut, wing nut, cotter pin, or the like. This may, in some cases, allow installation and removal without requiring a separate tool. For example, a wing nut could be manually tightened or loosened by hand. In such an example, the bolt head may be positioned underneath the seat cushion 30 so that the wing nut would be exposed from behind the chair 10. Additionally, the clamp 62 could be secured to attachment bracket 44 via any other attachment clamps, levers, connectors or brackets that would allow the clamp 62 to be appropriately tensioned against the attachment bracket 44 with a desired degree of manipulation.

Figure 5:
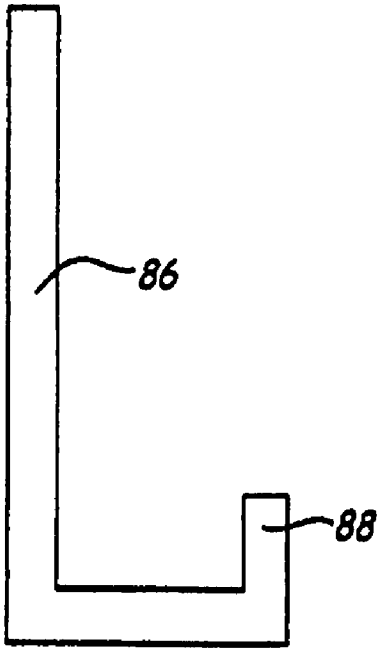
FIG. 5 is side, planar view of an alternative attachment clamp.

As mentioned above, some bleachers 14 may have lips 24 and recesses 22 (FIG. 1). In such a case, a J-clamp 86, as illustrated in FIG. 5, can be utilized. That is, the J-clamp 86 is secured to the attachment bracket 44 instead of the L-shaped attachment clamp 62. The J-clamp 86 includes a lip 88 that is received within recess 22 an may abut lip 24. The J-clamp provides additional security when attaching the seats 10.

With the use of either type of clamp 62, 86 the attachment of the stadium chair 10 to the bleacher 12 is a relatively quick and easy process that results in semi-permanent attachment. That is, the seat cannot be readily removed by a patron (without the aid of a tool such as a wrench). This serves to protect the chairs 10, reduce vandalism, reduce accidental damage, and prevent theft. Also, the chairs (if left over time) need only be positioned once.

Figure 7:
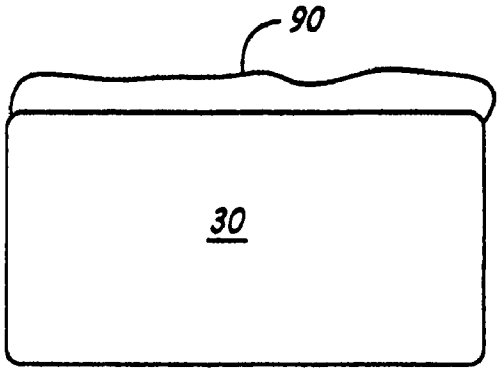
FIG. 7 is a top, planar view of the seat cushion and the securing strap of FIG. 6.
Figure 8:
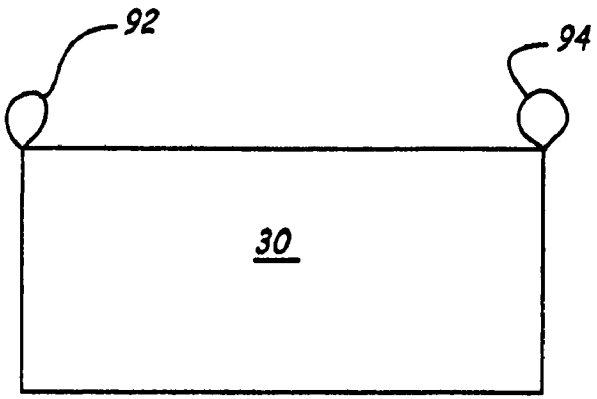
FIG. 8 is a top, planar view of the seat cushion with alternative securement straps for securing the seat cushion to the frame.
Figure 6:
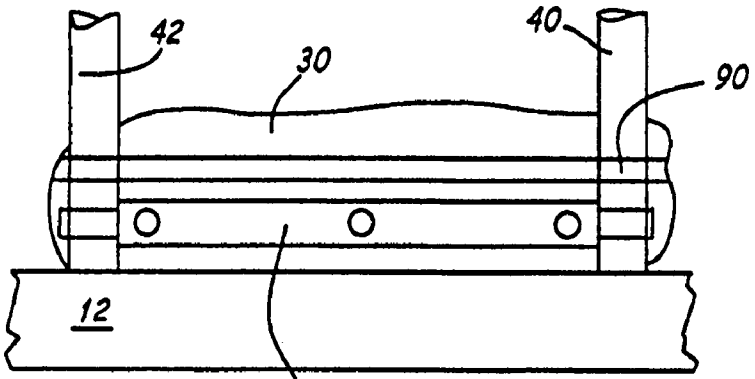
FIG. 6 is a rear, planar view of a securing strap for securing a seat cushion to the frame of the stadium chair.

In furtherance of many of these same goals, it may be desirable to secure the seat cushion 30 to the frame 26. FIGS. 6-7 illustrate having a single securement strap 90 connected to opposite rear corners of the seat cushion 30 that can be looped around the upright members 40, 42. This serves to hold the cushion 30 in the position illustrated and prevent it from being tipped forward. To attach, the cushion 30 is lowered into place while the strap 90 is simply slipped over the upright member 40, 42. Alternatively, the strap 90 could be openable or removable (e.g., hook and loop type fasteners. FIG. 8 illustrates an embodiment where two securing loops 92, 94 are provided. Each loop 92, 94 is placed around one upright member 40, 42 respectively. Again, the individual loops 92, 94 could be slid around the U-brackets 46, 48 of the frame 26, or they could be openable (e.g., buttons, hook and loop type fasteners, etc.). With solid loops 92, 94 it would be difficult and perhaps impossible for the seat cushion 30 to be removed while the frame 26 is secured to the bleacher, depending of course on how tightly the frame 26 engages the bleacher 12. In those cases where the cushion 30 could be removed or when using strap 90, the relevant straps could be further secured to the frame 26 and/or attachment bracket 44 with locking members (e.g., zip ties), if desired.

Figure 9:
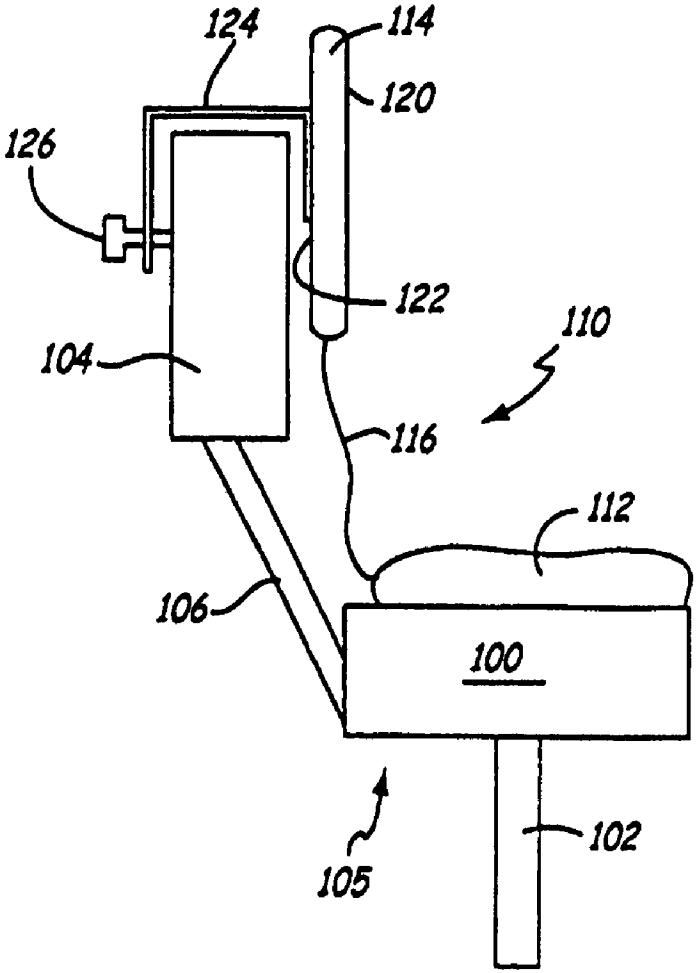
FIG. 9 is a side, planar view of a backed bleacher with a backed stadium seat attached.

FIG. 9 is a side, planar view of a backed bleacher 105 with a backed stadium seat 110 attached. A backed bleacher 105 is any stadium bleacher or bench type seat provided with a structure to support or abut a patron's back. The example illustrated includes a support member 102 and a bleacher seat 100. A bleacher back 104 is coupled to the bleacher seat by a back support column 106. Any number of arrangements are possible for backed bleacher seats and the back and seat portion may be integral, connected or completely separate.

The backed bleacher stadium seat 110 includes a seat cushion 112 which rests on the bleacher seat 100 to provide cushioned comfort to the patron. A back cushion 114 is connected to the seat cushion 112 by one or more flexible members. As illustrated, a first connecting strap 116 and a second connecting strap 118 act as the flexible member in this embodiment.

Figure 10:
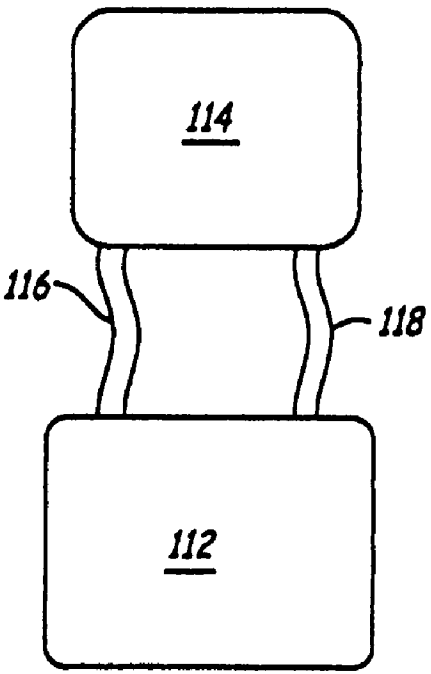
FIG. 10 is front/top planar view of the stadium seat for the backed bleacher.

The back cushion 114 includes a front surface 120 and an opposing rear surface 122 that is proximal the bleacher back 104. A back cushion bracket 124 securely couples the back cushion 114 to the bleacher back support 106. One such bracket 124 is illustrated and is sufficient for attachment; however, more than one bracket 124 (e.g., spacing two such brackets on opposite ends) may also be utilized to attach the back cushion 114. As the seat cushion 112 is coupled to the back cushion 114, the seat cushion is likewise retained proximate to the bleacher 105, though having some degree of permissible movement. FIG. 10 illustrates the interconnection between the back cushion 114 and the seat cushion 112, which are freely movable with respect to one another to the extent that the flexible connecting straps 116, 118 permit such a range of movement.

The backed bleacher stadium seat 110 can be attached to most any backed bleacher 105 to provide cushioned comfort for seating and for back support. As disclosed above, the stadium seat 110 could also be semi-permanently attached to the bleacher seat 105 by virtue of the bracket 124.

Figure 11:
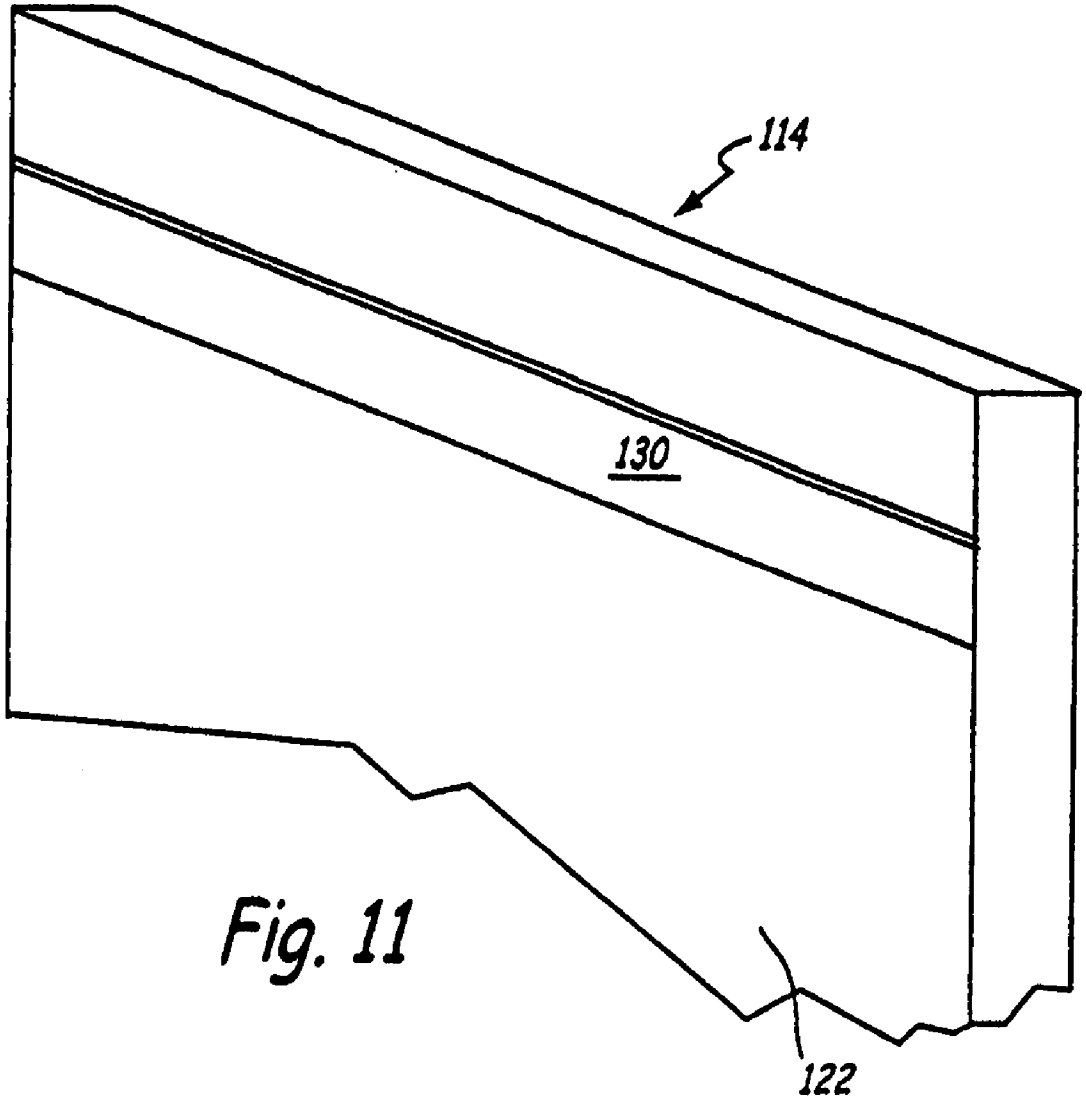
FIG. 11 is a isometric view of a portion of a back cushion of the stadium seat for the backed bleacher.
Figure 12:
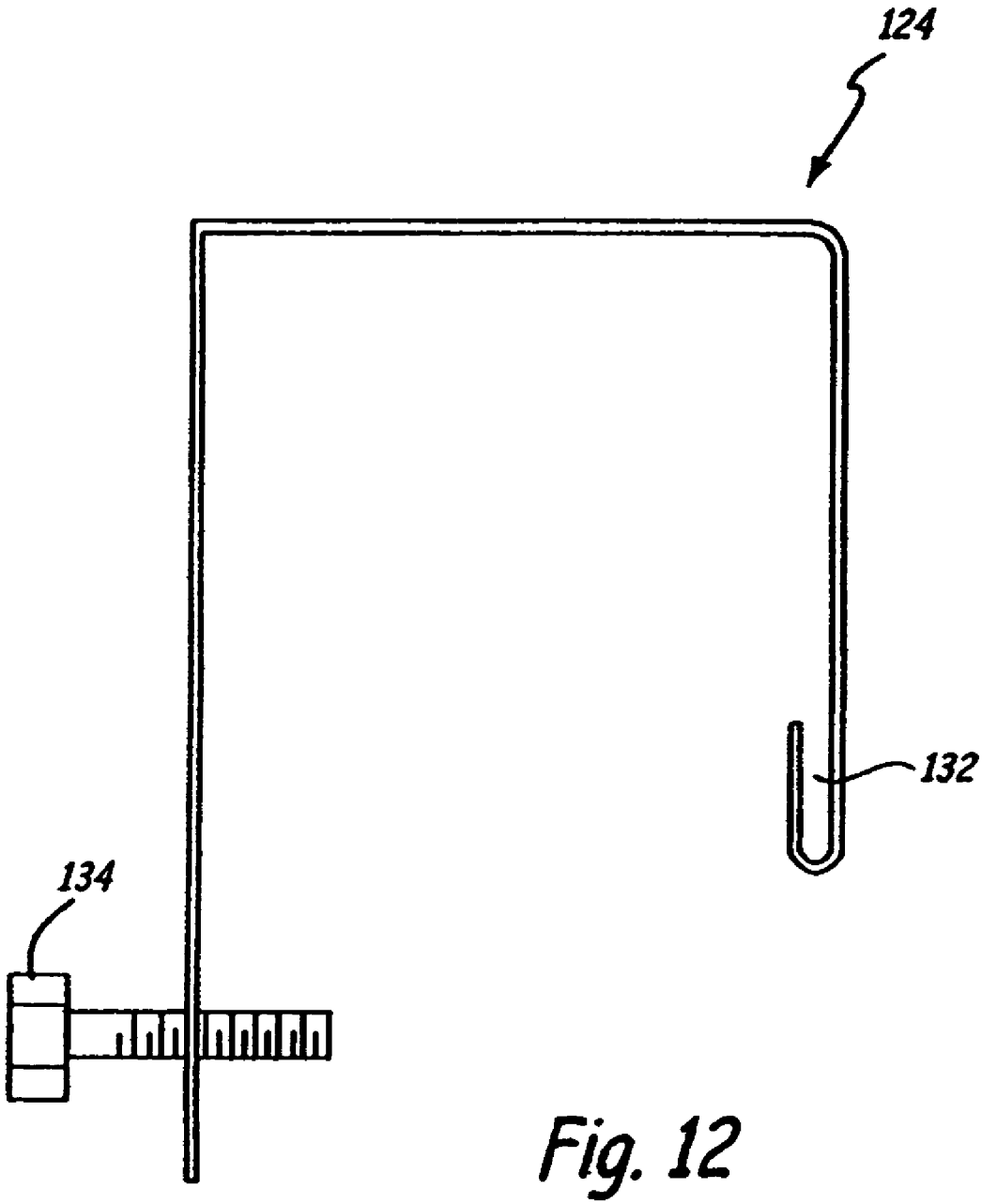
FIG. 12 is a side, planar view of a back cushion bracket for securing the stadium seat for the backed bleacher to the back rest portion of the bleacher.

FIGS. 11 and 12 illustrate one embodiment of the stadium seat 110 allowing for semi-permanent attachment. The rear surface 122 of the back cushion is provided with an attachment strap 130 that spans across at least a portion of the rear surface. As illustrated, strap 130 is provided from one vertical (as illustrated) edge to the opposite edge. This allows maximum adjustability.

A back cushion bracket 124 includes substantially C-shaped bracket having a strap loop 132 at one end and a threaded throughbore 135 at the other end for receiving a locking bolt 134. The bracket 124 is placed over the top portion of the bleacher back 104 (FIG. 9) and the locking bolt is advanced so as to exert pressure against the bleacher back 104 and hold the bracket 124 in place relative to the bleacher back 104. The attachment strap 130 of the cushion 114 is received by the strap loop 132, thus securing the back cushion 114. Depending upon the tension exerted, the back cushion may be horizontally slidable relative to the bleacher back 104; the amount of such movement being determined by the length and flexibility of the attachment strap 30.

In addition to using the stadium seat 110 on a backed bleacher, the seat 110 may also be used on a club seat. Club seats are often provided in stadiums and have a seat portion and a back portion forming a chair. The seat portion often folds upwards towards the back portion to allow more space in an aisle. The use of the stadium seat 110 on a club seat is substantially similar to the use described above. In addition, the seat cushion 112 may be provided with a strap (not separately shown) that is substantially similar to the attachment strap 130 provided on the back cushion 114 (FIG. 11). Such a strap could then be slid under the seat portion of the club seat, serving to retain the seat cushion 112 in place. This is particularly useful on those club seats that fold upwards, as the seat cushion 112 need not be repositioned or reattached each time the patron rises and the club seat folds.

Figure 14:
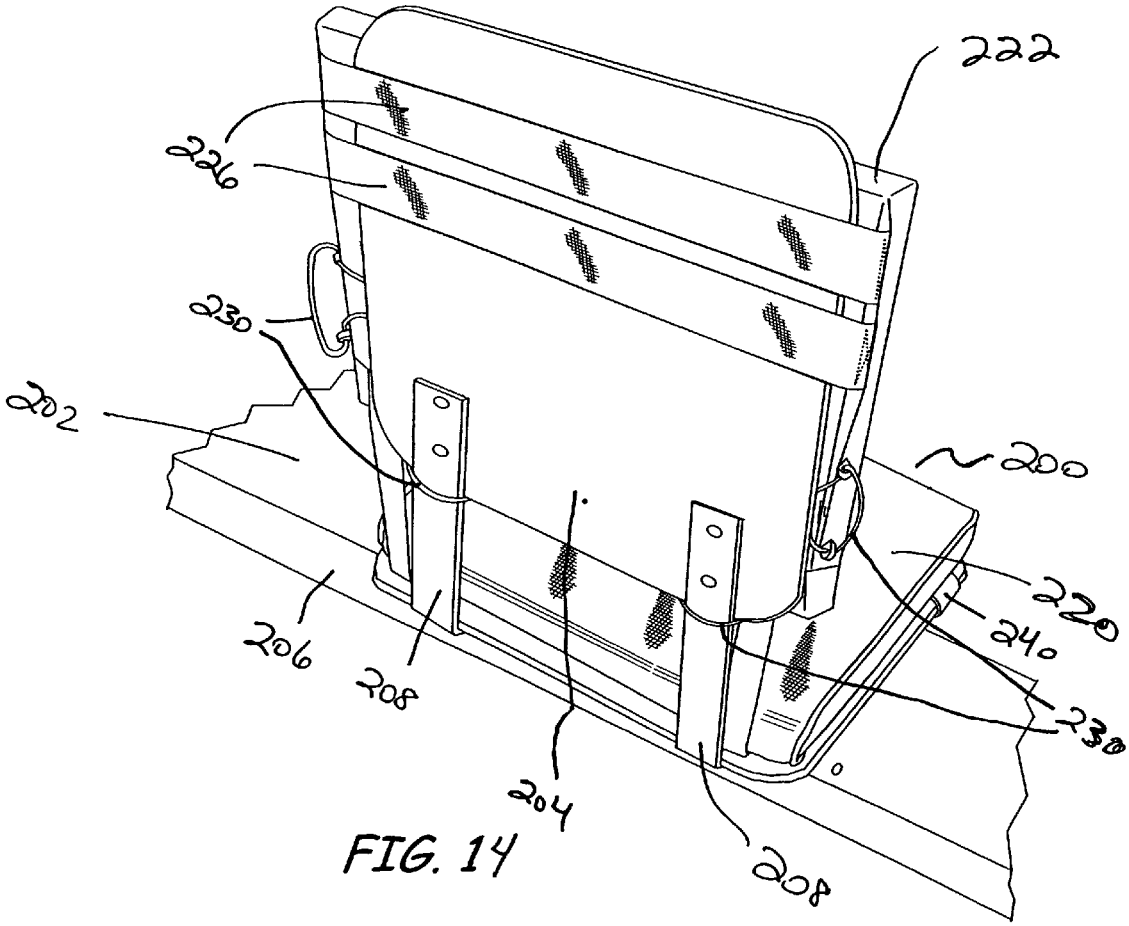
FIG. 14 is a rear perspective view depicting a cushion attached to a portion of a stadium seat, according to one embodiment of the present invention.

FIG. 14 is a perspective view of a stadium cushion 200 attached to a backed bleacher 202, according to an alternative embodiment of the present invention. In this embodiment, the backed bleacher has an separate bleacher back 204 for each seat. The bleacher back 204 is connected to the bench or bleacher 206 by back support elements 208.

Figure 15:
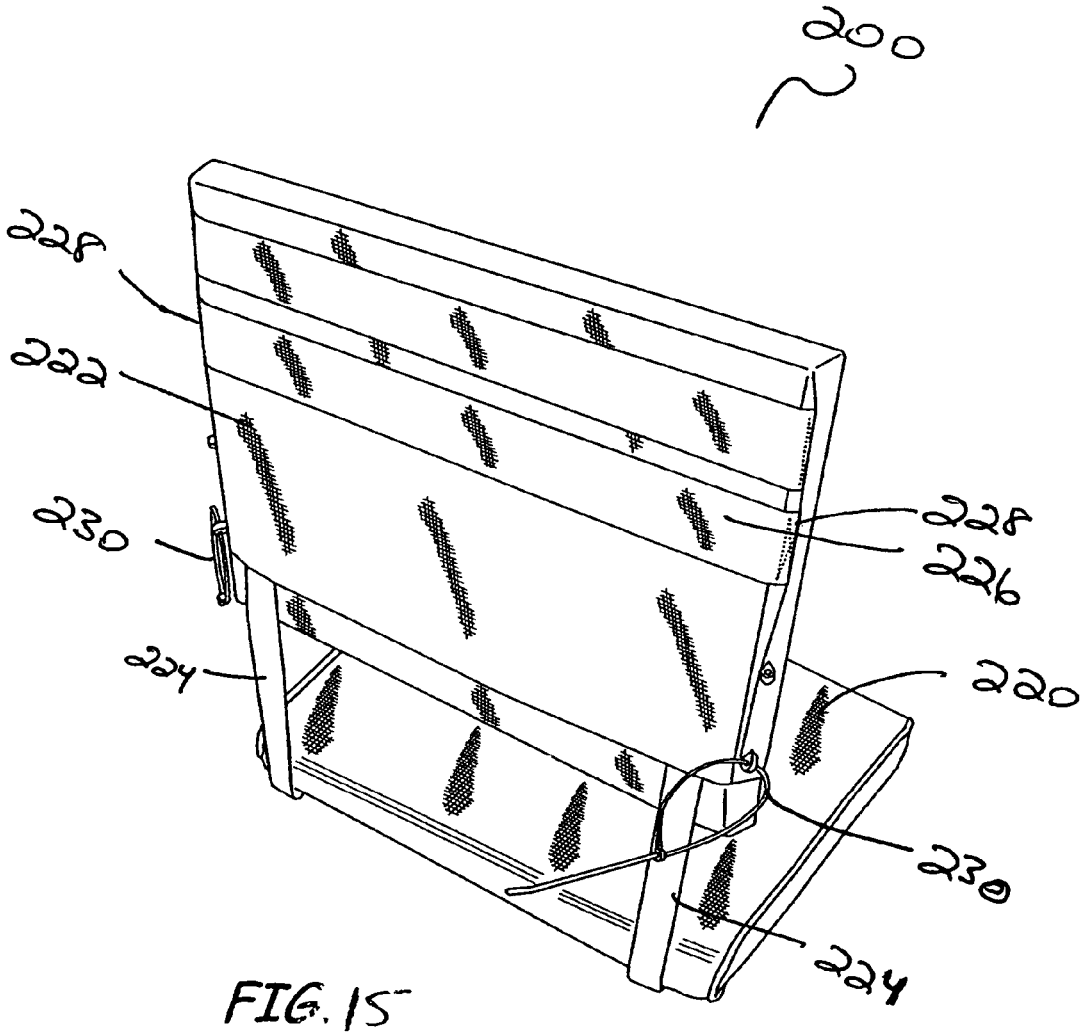
FIG. 15 is a rear perspective view showing a cushion, according to one embodiment of the present invention.

FIG. 15 is a rear perspective view of the stadium cushion 200, according to one embodiment of the present invention. The stadium cushion 200 has a seat cushion 220 and a back cushion 222 that are connected by two connection elements 224. The connection elements 224, in one aspect of the invention, are two flexible straps that allow for the respective positions of the two cushions 220, 222 to be varied for ease of use and transport. Alternatively, the connection elements 224 can be any known device allowing for flexible connection of the seat cushion 220 and the back cushion 222. In a further alternative, the connection element 224 can be a one element allowing for flexible connection of the two cushions 220, 222.

The back cushion 222 has a seat back attachment element 226. According to one embodiment, the seat back attachment element 226 is a stretchable strap that stretches along the back side of the back cushion 222 and is connected at each end 228 to the cushion 222. Alternatively, the seat back attachment element can be any known device for attaching the seat cushion 222 to the seat back 204.

The back cushion 222 also has support attachment elements 230. According to one embodiment, the support attachment elements 230 are adjustable plastic loops that are connected to the back cushion 222 on opposing sides of the back cushion 222. In one embodiment, the support attachment elements 230 are similar to zip ties. Alternatively, the support attachment elements 230 are any known devices for attaching the back cushion to the back support elements 208.

Figure 16:
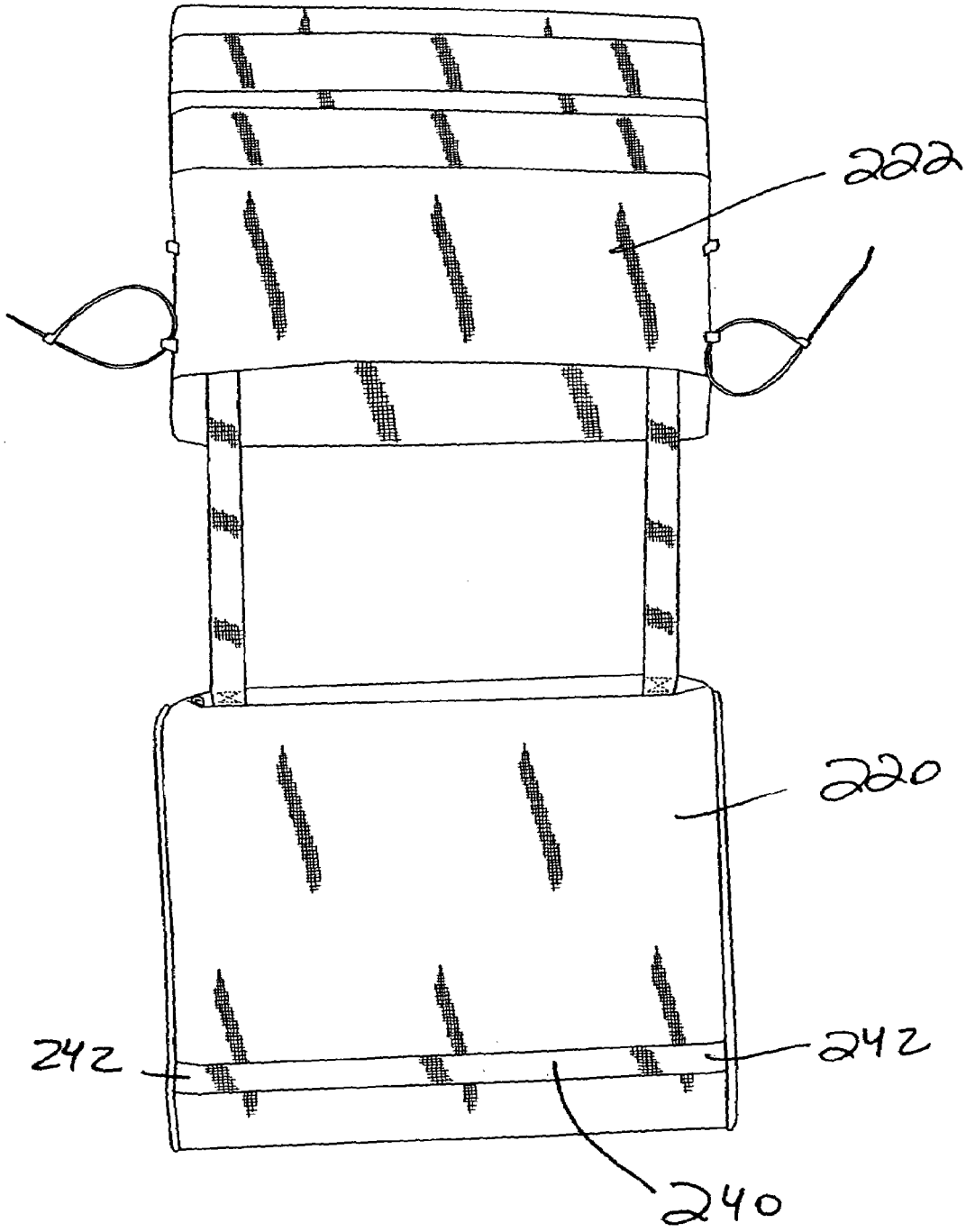
FIG. 16 is a back planar view illustrating a cushion, according to one embodiment of the present invention.

FIG. 16 depicts the back of the back cushion 222 and the underside of the seat cushion 220, according to one embodiment of the present invention. The underside of the seat cushion 220 includes a seat attachment element 240. According to one embodiment, the seat attachment element 240 is a stretchable strap that stretches along the underside of the seat cushion 220 and is connected at each end 242 to the cushion 220. Alternatively, the seat attachment element 240 can be any known device for attaching the seat cushion 220 to the bleacher seat 206.

In use, the stadium cushion 200 is configured to be used with several types of stadium seating. That is, the stadium cushion 200 can be attached to a bleacher seat with separate seat backs as shown in FIG. 14. The seat back attachment element 226 is stretched over the seat back 204 by positioning the back cushion 222 such that the seat back 204 is slid between the seat back attachment element 226 and the back cushion 222. The seat back attachment element 226 thereby stabilizes and maintains the position of the back cushion 222 in relation to the seat back 204.

In addition, the stadium cushion 200 according to one embodiment can be further attached to a stadium seat via the support attachment elements 230. Each element 230 can be attached to a back support element 208 as shown in FIG. 14. The back cushion 222 is thereby further stabilized.

Further, the stadium cushion 200 according to one aspect of the present invention is further attached to the stadium seat using the seat attachment element 240 as shown in FIG. 14. The seat attachment element 240 is stretched over the seat 206 by positioning the seat cushion 220 such that the seat 206 is slid between the seat attachment element 240 and the seat cushion 220. The seat attachment element 240 thereby stabilizes and maintains the position of the seat cushion 220 in relation to the seat 206.

Alternatively, the stadium cushion 200 could also be attached to any club seat as described herein. In a further alternative, the stadium cushion 200 is intended to be attachable to several other types of stadium seating.

Shown generally in the drawings is an additional alternative embodiment of a seat cushion 310 that is suitable for attachment to a bleacher 312 (shown in phantom lines), or other similar base portion. As will be seen in the drawings and following description, the seat cushion 310 is adapted for quick and convenient attachment to a bleacher 312 in a semi-permanent fashion to provide a comfortable seat that provides padding and back support for a user.

Figure 17:
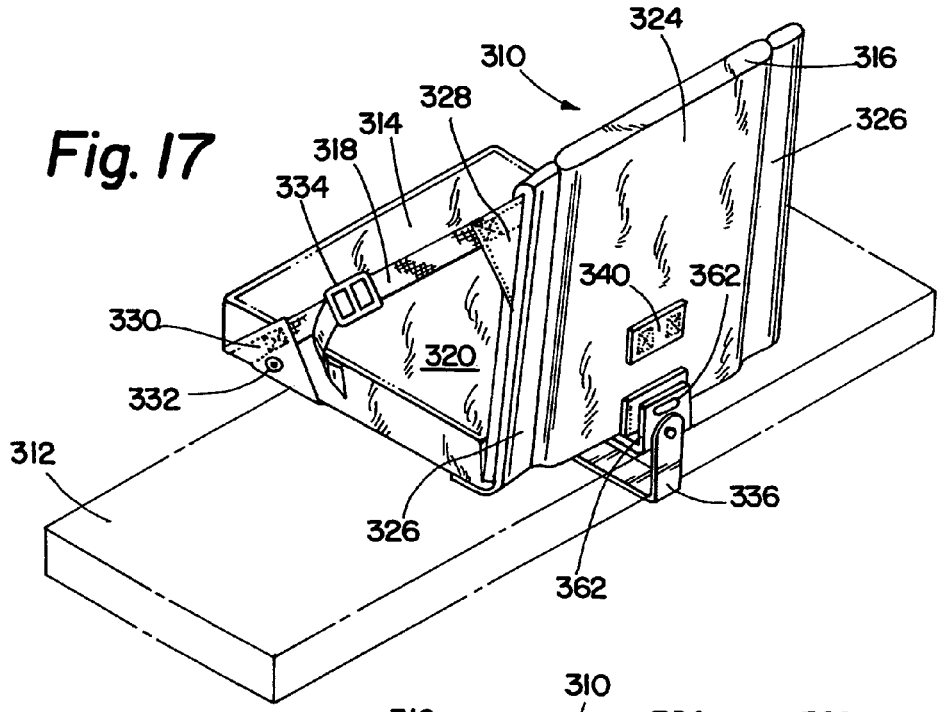
FIG. 17 is an isometric view of a seat cushion according to one embodiment of the present invention.

FIG. 17 is an isometric view of a seat cushion 310 according to one embodiment of the present invention. The top portion of a bleacher 312 is indicated in phantom lines. It should be appreciated that the seat cushion 310 could be modified to fit a variety of sizes and shapes of bleachers, or other support structures. The seat cushion 310 includes a bottom portion 314 and a back portion 316. The bottom cushioned portion 314 provides a padded surface on which a user may sit, and the back portion 316 provides a backrest to provide support for a user's back.

The bottom portion 314 is a padded cushion. It may include a covering 320 surrounding and protecting a pad 322 (not visible in FIG. 17, see FIG. 24). The covering 320 may be made of any suitable protective material. Most preferably the material will be flexible, durable, comfortable to sit on, and weather resistant. Preferably, it will not fade excessively, or degrade significantly from prolonged exposure to sunlight, and other elements. Suitable coverings 320 may include nylon fabric, vinyl, canvass, rubber, and the like. It may be desired to match the coloring of the covering 320 with the color of the bleacher 312, or with the color scheme of a school or team. The covering 320 could be decorated with a logo, name, or other image, if desired. The pad 322 is included to provide a comfortable cushioning layer between a user and a bleacher 312. The pad 322 may be made from any suitable cushioning material such as sponge, foam rubber, synthetic stuffing, and the like. It should be thick enough to provide comfortable cushioning, but not so thick as to unduly raise the height of the seating surface. Preferably it is deep enough to cover the entire depth of the bleacher 312. It should be wide enough to provide a comfortable space for a user to sit. The pad 322 may be generally flat, or may be contoured to match a user's anatomy.

The back portion 316 includes a central cushioned portion 324 between two riser portions 326. The central cushioned portion 324 is formed similarly to the bottom portion 314 described above. It has a covering 320 around a pad 322 (not shown in FIG. 17, see FIG. 24). The riser portions 326 provide support and stability to the central cushioned portion 324. The bottom portion 314 and the back portion 316 are preferably joined together in a hinged or pivotal relationship, near a back end of the bottom portion 314 and a bottom end of the back portion 316.

A gusset 328 is provided near the top of each riser 326. This gusset 328 serves as an attachment point for a flexible belt 318. A similar triangular gusset 330 is provided near the front of the bottom portion 314, and serves as an attachment and reinforcement point for the flexible belt 318 to the bottom portion 314. The gussets 328 and 330 are preferably made of a strong, flexible material similar to the covering 320. They may be attached to the covering 320 of their respective cushioned portions 314 and 316 by sewing, riveting, adhesive or other fastening mechanisms known to those of skill in the art. Alternatively, the gussets 328 and 330 may be formed from the same piece of material as their respective coverings. The lower gusset 330 is provided with an eyelet 332, which is preferably in the form of a reinforced grommet made of metal or plastic.

Belt 318 is preferably adjustable in length. As such, the belt 318 may be formed by two separate straps connected by a buckle 334. Other mechanisms for lengthening and shortening the belt will be known to those of skill in the art, for example, a hook and loop fastener such as commonly sold under the trade name Velcro. The belt 318 acts as a flexible constraint element for restraining the back portion 316 from rotating beyond a desired angle with respect to the bottom portion 314. The belt 318 should be made from a thin, flexible material that is sufficiently strong to maintain the desired angle between the bottom portion 314 and the back portion 316 when a user sitting on the bottom portion 314 leans back against the back portion 316. The preferred material is a nylon belt, but other materials may be acceptable as well.

An attachment clamp 336 is used to fasten the seat cushion 310 to the bleacher 312. A patch 338 may be applied at the rear bottom of the back surface of the bottom portion 314 in order to protect and reinforce the covering 320 against contact with the attachment clamp 336. A loop 340 may be provided on the back surface of the bottom portion 314 in alignment with and above the attachment clamp 336. A zip tie 375 (see FIG. 24) or other fastener (not shown) may be threaded through the loop 340 to connect it with the attachment bracket 336 in order to maintain the back portion 316 in a generally upright orientation.

Figure 18:
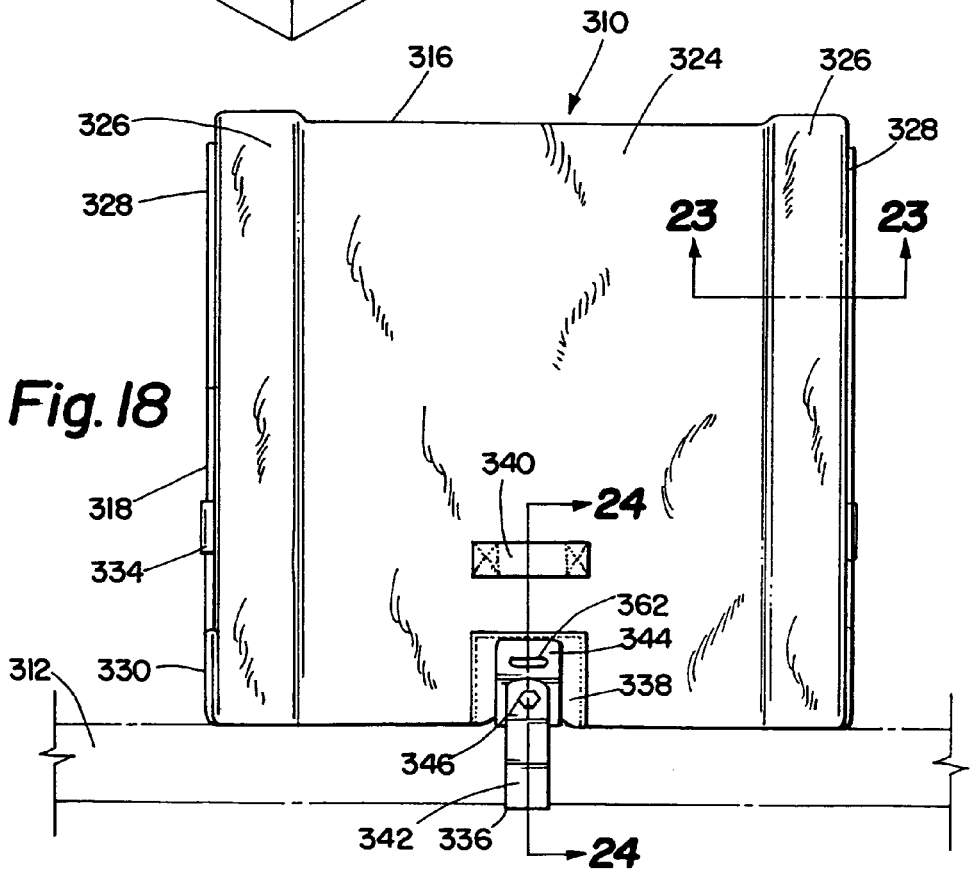
FIG. 18 is a rear elevation view of the seat cushion according to FIG. 17.
Figure 19:
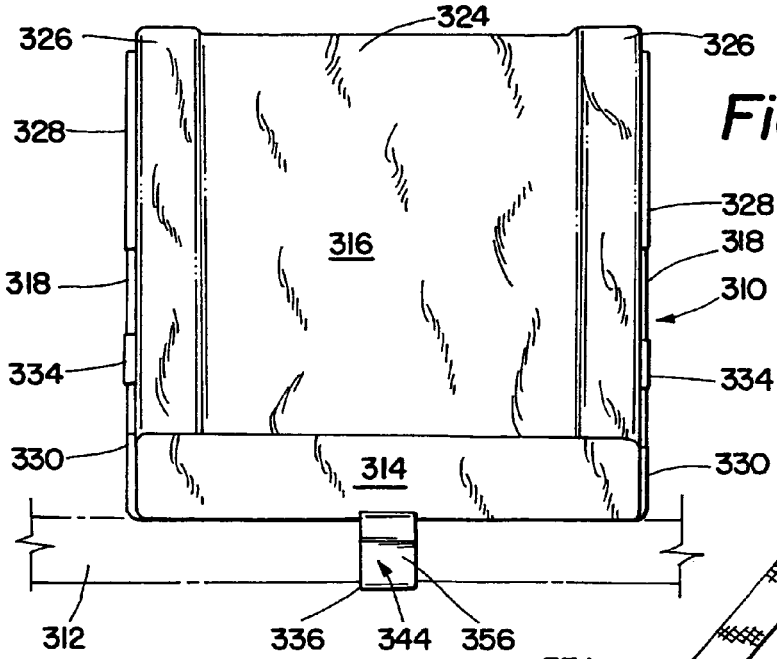
FIG. 19 is a front elevation view of the seat cushion according to FIG. 17.

FIG. 18 is a rear view of the seat cushion 310 shown in FIG. 17. FIG. 19 is a front view of the seat cushion 310 shown in FIG. 17. As can be seen in FIGS. 2 and 3, in use, the seat cushion 310 rests flat against the top surface of a bleacher seat 312. Specifically, the bottom surface of the bottom portion 314 rests on top of the bleacher 312. As seen in FIG. 18, attachment clamp 336 includes a rear jaw 342 that extends below and engages the bleacher 312. A front jaw 344 extends all the way to the front of the bleacher 312, and is visible in both FIGS. 2 and 3. A threaded fastener 346 is used to join the two jaws 342 and 344 together. Preferably the jaws 342 and 344 are made from steel bent into the desired shape. The jaws 342 and 344 should be durable, rigid, and resistant to corrosion.

Figure 20:
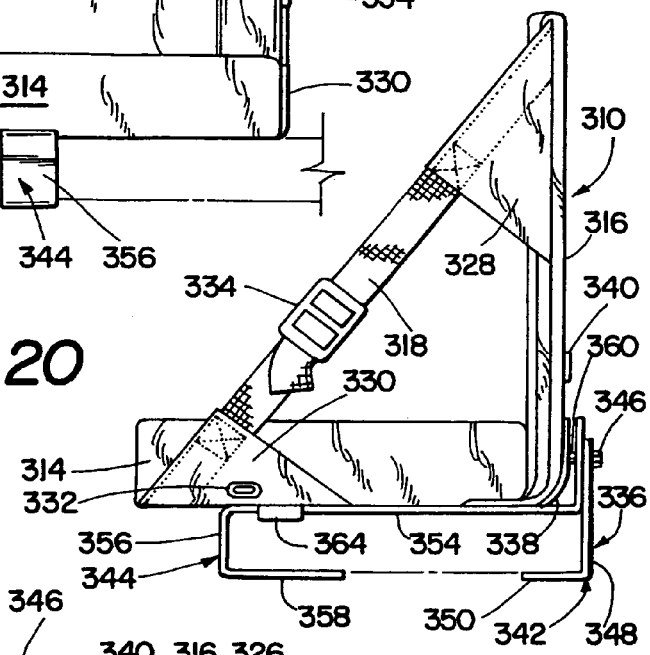
FIG. 20 is a side elevation view of the seat cushion according to FIG. 17.
Figure 24:
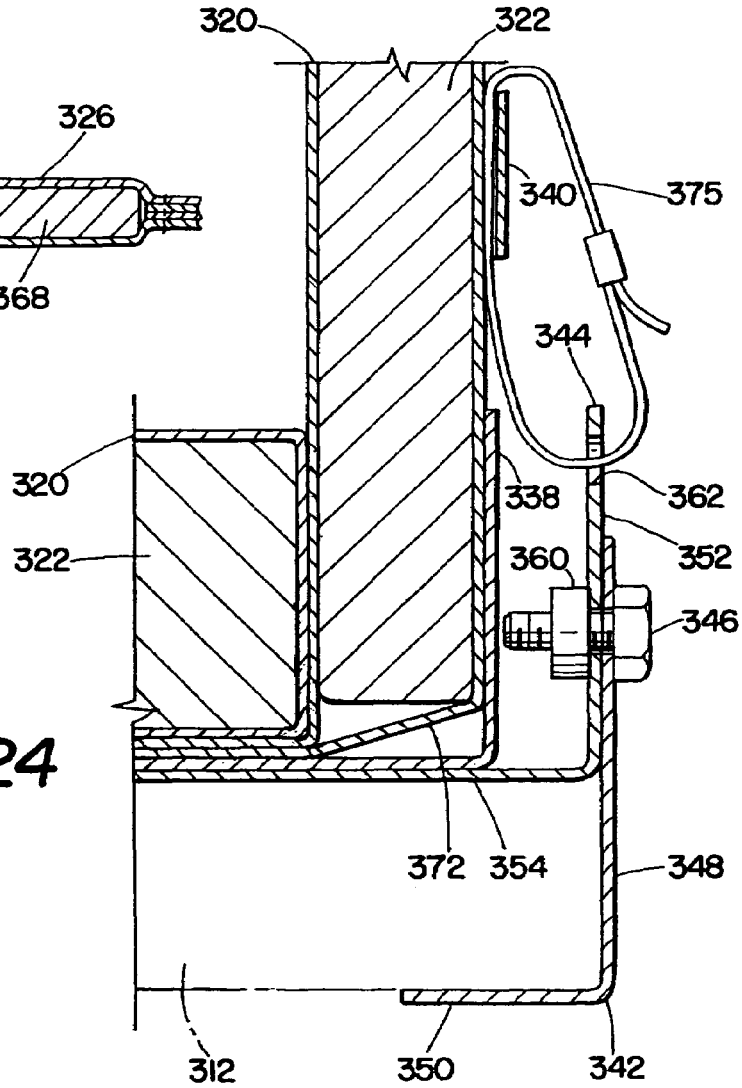
FIG. 24 is a partial sectional view taken along line 24-24 of FIG. 18, including a zip tie retaining the backrest in an upright orientation.

The features of the attachment clamp 336 are best seen in FIGS. 20 and 24. With reference to FIG. 20, it can be seen that the rear jaw 342 is a generally L-shaped bracket that includes a vertical leg 348 and a horizontal leg 350. In use, the rear jaw 342 wraps around and engages a rear portion of the bleacher 312. With further reference to FIG. 20, it can be seen that the front jaw 344 is a bracket with a somewhat serpentine cross section. It has a rear vertical leg 352, a long horizontal leg 354, a front vertical leg 356, and a front horizontal leg 358. Threaded fastener 346 engages a threaded receiver 360 to fasten the rear jaw 342 to the front jaw 344, and thereby clamp the bleacher 312 between the jaws 342 and 344. The threaded receiver 360 may be a loose nut. More preferably, the threaded receiver 360 is fixed, as by welding, to the rear vertical leg 352 of the front jaw 344. It should be appreciated that the orientation of the threaded fastener 346 and the threaded receiver 360 could be reversed, though the orientation shown is preferred for ease of access to the head of the threaded fastener 346, and so that the end of the threaded fastener 346 does not extend into an area between bleachers 310 where people may be walking and catch their legs on the exposed end. In the preferred orientation shown, patch 338 reinforces and protects covering 320 from snagging or wearing from contact and rubbing with the end of the threaded fastener 346 and the front jaw 344. The rear vertical leg 352 of the front jaw 344 extends higher than the vertical leg of the rear jaw 342, and includes a slot 362 near its top end. It should be appreciated that the relative heights of the rear vertical legs 348 and 354 reversed, and the slot 362 could be provided in the rear jaw 342 as an alternative.

Figure 22:
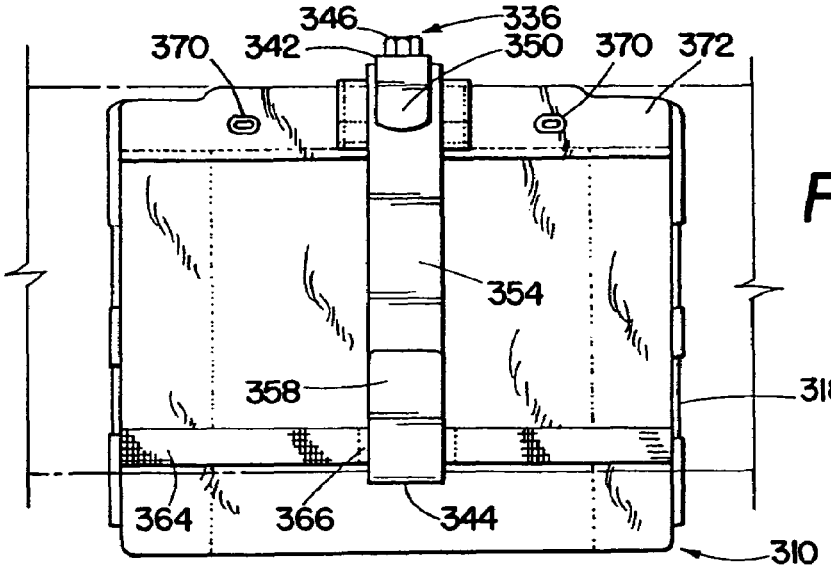
FIG. 22 is a bottom plan view of the seat cushion according to FIG. 17.

As best seen in FIG. 22, the bottom surface of the bottom portion 314 includes a belt 364 with a loop 366 formed about midway across the width of the seat bottom portion 314. The loop 366 is formed in the shown embodiment by leaving a central portion of the belt 364 loose, or unstitched, from the bottom surface of the bottom portion 314. The loop 316 is used to attach the seat 310 to the attachment clamp 336. Specifically, the front jaw 344 is threaded through the loop 366 until the loop 316 is in the position shown in FIG. 20 on the long horizontal leg 354.

The back portion 316 and the bottom portion 314 are connected in a hinged or pivotal relationship. In the embodiment shown, a hinge 372 is formed by the covering 320. Specifically, as seen in FIG. 24, a single piece of material is used form the covering 320 for both the back portion 316 and the bottom portion 314. A gap, or space, is left between the pads 322 of the back 314 and bottom 314 portions within the covering 320. This gap provides a flexible portion that acts as a hinge 372. Alternatively, the back portion 316 and bottom portion 314 could be formed separately and joined together by a separate hinge structure.

The hinge portion 372 of the embodiment shown includes a pair of openings 370 visible in FIG. 22. These openings 370 are preferably reinforced by metal or plastic grommets or eyelets. These openings 370 provide additional attachment points for fasteners, as well as providing drainage ports for water that could otherwise collect in the hinge portion 372.

Figure 21:
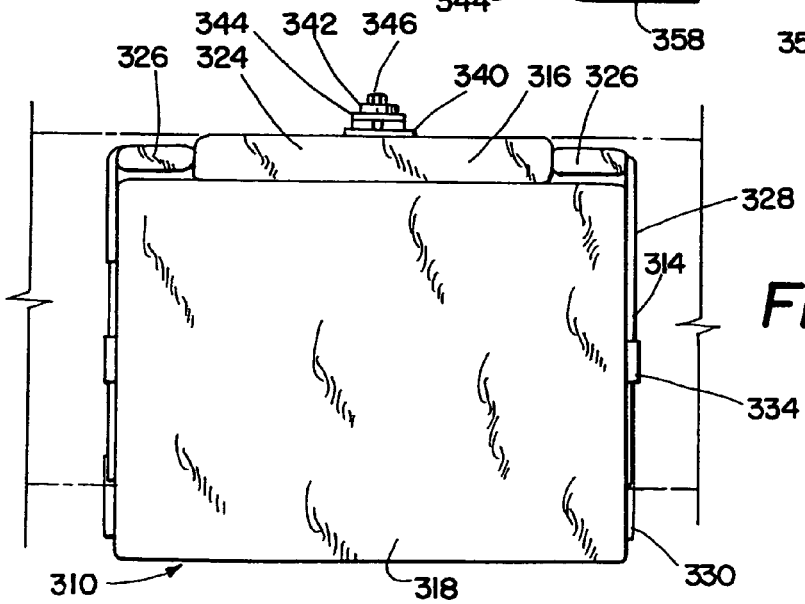
FIG. 21 is a top plan view of the seat cushion according to FIG. 17.
Figure 23:
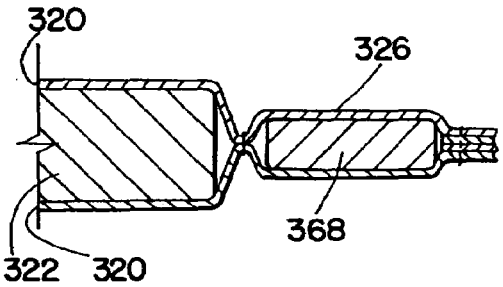
FIG. 23 is a partial sectional view taken along line 23-23 of FIG. 18.

The back portion 316 includes a pair of riser portions 326 on opposite ends, as seen in the top view of FIG. 21. The riser portions 326 provide support for the central cushioned portion 324 that acts as an ergonomic back rest. The riser portions 326 may be formed from any suitable structure that provides vertical and lateral support for the central cushioned portion 324. In the embodiment shown, riser inserts 368 are sewn within pockets formed in the covering 320, as shown in the cross-sectional view of FIG. 23. These riser inserts 368 may be formed from relatively rigid materials such as hard plastic, wood, or metal.

There are no cross members across the back portion 316. Instead, the entire structural support for the back portion 316 is provided by the riser portions 326, the pad 322, and flexible belts 318.

Attachment of the seat cushion 310 to the bleacher 312 is accomplished as follows. First, the seat cushion 310 is connected to the attachment clamp 336 by threading the front jaw 344 through the loop 366 in belt 364 on the bottom surface of the bottom portion 314. The front jaw 344 may then be placed in engagement with the bleacher 312 in the desired location with the front portion of the bleacher 312 retained by the front horizontal leg 358 and front vertical leg 356 of the front jaw 344. The long horizontal leg 354 should rest on the top surface of the bleacher 312 and should run generally from the front of the bleacher 312 to the rear of the bleacher 312 in a generally perpendicular alignment. The rear jaw 342 can then be secured to the front jaw 344 by inserting threaded fastener 346 though the rear jaw 342 into the threaded receiver 360 and then tightening the threaded fastener 346. A wrench may be used to provide additional leverage in tightening the threaded receiver 360. The bleacher 312 should be securely captured between the front jaw 344 and the rear jaw 342, thereby fastening the attachment clamp 336 to the bleacher 312. The seat cushion 310 is secured to the clamp 336 by virtue of loop 366 being retained by the long horizontal leg 354. To further secure the seat cushion 310 to the clamp 336, a zip tie, or similar attachment may threaded between loop 340 on the rear of the back portion 316 and the slot 362 near the top of the vertical leg 348 of the rear jaw 342.

The belts 318 can be adjusted to limit the distance the back portion 316 will pivot rearward. Typically a user will adjust the belts 318 so that the back portion 316 will not pivot much beyond a perpendicular orientation. When not in use, the belts 318 may be shortened to that the back portion 316 retained close to the bottom portion 314 in a closed storage position. In this closed storage position the back portion 316 covers and protects a portion of the bottom portion 314 from rain, dust, and sun exposure to improve the life of the bottom portion 314. The overall profile of the seat cushion 310 is also lowered in the closed storage position, to reduce the strain caused by wind.

When the seat cushion 310 is in place on the bleacher 312, it allows a user to sit more comfortably than on a plain bleacher 312. The bottom portion 314 provides cushioning and the back portion 316 provides support for the user's back. Because there are no hard cross members spanning across the back portion person's walking, sitting, or standing in the aisle behind the seat cushion 310 need not worry about banging their shin or other part of their leg on a hard cross-member.

The seat cushion 310 may be easily removed from the bleacher 312 for storage. It is contemplated that users may leave the seat cushion 310 in place on the bleacher 312 during an entire season, and then remove the seat cushion 310 during the off season. Of course, user's may choose to leave the seat cushion 310 attached more or less permanently, or may be removed after each event. To remove the seat cushion 310, the threaded fastener 346 is loosened, typically with a wrench, and the jaws 342 and 344 of the clamp 336 are spread apart and disengaged from the bleacher 312.

Although the present invention has been described with reference to preferred embodiments, persons skilled in the art will recognize that changes may be made in form and detail without departing from the spirit and scope of the invention.

I claim:

1. An attachment bracket for attaching a seat cushion to a bleacher seat, the attachment bracket comprising:

a front jaw, said front jaw including a front hook portion, a long horizontal leg extending from said hook portion to a distance away from the front hook portion, and a generally upwardly extending rear leg;

a rear jaw, said rear jaw including a generally upwardly extending leg in close proximity to said generally upwardly extending rear leg of said front jaw;

a tightening member for drawing said generally upwardly extending legs together to secure said jaws;

an aperture located in said generally upwardly extending rear leg of said front jaw;

a seat cushion, said seat cushion connected to a backrest;

said backrest having a front portion and back portion;

a loop connected to said back portion of said backrest;

wherein said loop on said back portion of said backrest connects to said aperture by a removable fastener, said loop receiving one portion of said removable fastener and said aperture receiving another portion of said removable fastener.

2. The attachment bracket of claim 1, wherein said tightening member is a threaded member.

3. The attachment bracket of claim 1 further comprising:

said seat cushion including a top surface and a bottom surface;

a loop attached to said bottom surface of said seat cushion;

wherein said long horizontal leg of said front jaw is adapted to engage said loop on said bottom surface of said seat cushion.

4. The attachment bracket of claim 1 further comprising:

said seat cushion including a top surface and a bottom surface;

a loop attached to said bottom surface of said seat cushion, wherein said long horizontal leg of said front jaw is adapted to engage said loop on said bottom surface of said seat cushion.

5. The attachment bracket of claim 1 further comprising:

said seat cushion including a top surface and a bottom surface;

a belt attached to said bottom surface of said seat cushion, said belt further comprising a loop;

wherein said long horizontal leg of said front jaw is adapted to engage said loop of said belt on said bottom surface of said seat cushion.

6. The seat cushion of claim 1 further comprising:

a bottom cushioned portion adapted to set on an upwardly facing surface of a bleacher, the bottom cushioned portion having a bottom surface for resting on the bleacher;

an attachment member connected to the bottom surface of the bottom cushioned portion having a receiving portion adapted to removably receive said attachment bracket above the upwardly facing surface of the bleacher for securing the bottom cushioned portion to a bleacher; and a flexible constraint element connecting said bottom cushioned portion to said backrest.

7. The seat cushion of claim 1 wherein:

said seat cushion comprises a seat pad enclosed by a seat covering;

said backrest comprises a backrest pad enclosed by a backrest covering; and said backrest covering and said seat covering are formed from a single piece of covering material, such that said single piece of covering material flexibly connects said back portion to said bottom cushioned portion.

8. The backrest of claim 1 further comprising:

a pair of laterally spaced apart risers;

a central cushioned portion between said risers; and a backrest cover covering and binding together said risers and said central cushioned portion, said backrest cover further acting as a flexible connection between said backrest and said seat cushion.

* * * * *